United States Patent [19]

Sapienza, IV

[11] Patent Number: 4,872,426

[45] Date of Patent: Oct. 10, 1989

[54] VARIABLE CAMSHAFT TIMING SYSTEM

[75] Inventor: Samuel J. Sapienza, IV, Hampton, Va.

[73] Assignee: Siemens-Bendix Automotive Electronics L.P., Troy, Mich.

[21] Appl. No.: 181,867

[22] Filed: Apr. 15, 1988

Related U.S. Application Data

[63] Continuation of Ser. No. 17,670, Feb. 24, 1987, Pat. No. 4,744,338.

[51] Int. Cl.[4] ..... F01L 1/34

[52] U.S. Cl. ..... 123/90.15; 123/90.17; 474/900

[58] Field of Search ..... 123/90.15–90.17, 123/90.31; 474/133, 134, 900

[56] References Cited

U.S. PATENT DOCUMENTS

| | | | |
|---|---|---|---|
| 3,888,217 | 6/1975 | Hisserich | 474/900 |
| 4,530,318 | 7/1985 | Semple | 123/90.17 |
| 4,576,127 | 3/1986 | Doi | 123/90.15 |

FOREIGN PATENT DOCUMENTS

| | | | |
|---|---|---|---|
| 59-63338 | 4/1984 | Japan | 123/90.15 |
| 651109 | 8/1985 | Switzerland . | |
| 2088471 | 6/1982 | United Kingdom . | |

OTHER PUBLICATIONS

Patent Abstracts of Japan, vol. 8, No. 166 (M-314)(1603) 8/1984.

Patent Abstracts of Japan, vol. 10, No. 109 (M0472)(2166) 4/1986.

*Primary Examiner*—Noah P. Kamen

*Attorney, Agent, or Firm*—Russel C. Wells; George L. Boller

[57] ABSTRACT

A variable camshaft timing system for an internal combustion engine varies the relative angular position between the intake camshaft and the exhaust camshaft by controlling the path of the timing belt. First and second idler arms, each having an idler wheel connected thereto, are independently pivoted around a common pivot point by means of a pair of positioning cams operatively connected to an electric stepping motor. The motor is controlled from an electronic control unit which receives signals indicating the engine operating characteristics and through a look-up table steps the positioning cams which in turn pivots the idler arms to rotate the intake camshaft relative to the exhaust camshaft thereby changing the intake valve timing.

13 Claims, 1 Drawing Sheet

VARIABLE CAMSHAFT TIMING SYSTEM

This application is a continuation of prior complete application Ser. No. 017,670 filed on Feb. 24, 1987, now U.S. Pat. No. 4,744,338.

This invention relates to timing systems for internal combustion engines and more particularly to variable camshaft timing systems as may be found on overhead cam engines.

BACKGROUND OF INVENTION

Prior Art

Prior art systems such as that shown in U.S. Pat. No. 4,484,543, entitled "Adjustable Non-throttling Control Apparatus For Spark Ignition Internal Combustion Engines" illustrate the changing of the belt length from two shafts. Along the belt path is a pair of idler wheels, wherein one wheel is moved by an external mechanism, such as a throttle of an engine, and the other wheel is moved under the force of a spring. In this system, a constant level of tension in the belt is not maintained.

U.S. Pat. No. 4,438,737, entitled "Apparatus and Method For Controlling The Valve Operation of an Internal Combustion Engine" illustrates a pair of idler arms controlling the path of a timing belt from the crankshaft to the camshaft. The upper idler arm is controlled by an electric motor which changes the length of a rod to pivot the upper idler arm. The lower idler arm follows the belt. The tension level in the belt is not maintained.

U.S. Pat. No. 4,530,318, entitled "Intake and Exhaust Valve System For Internal Combustion Engine" illustrates a means for moving the position of a controlled idler pulley between two driven pulleys to change the relative position of each of the driven pulleys relative to each other. A pair of idler pulleys is adjusted by the belt as the controlled idler pulley is repositioned. The tension level in the belt is not maintained.

U.S. Pat. No. 3,986,484, entitled "Camshaft for Controlling Variably Opening Valves" illustrates a linkage means for axially moving a camshaft while at the same time transversely moving a pair of idler wheels on the belt between a crankshaft and a pair of camshafts. The idler rollers are in a rigid spatial relationship on either side of one of the camshafts. As the camshafts are axially moved, the angular relationship between the two camshafts is altered. In this system the tension level in the belt is not maintained since both idler rollers move the same amount.

In all of the above systems, the tension level in the belts being variable will provide inaccurate timing during each engine operation.

Summary of Invention

It is principle object and advantage of this invention to maintain optimum intake event timing on a twin cam engine throughout the speed range and operating conditions of the engine.

It is another object of this invention to maintain the tension in the timing belt drive of an internal combustion engine.

It is an advantage of this invention to schedule which outputs of the internal combustion engine will be optimized such as idle quality could be optimized at idle; hydrocarbons in the emissions could be minimized at part throttle conditions; or torque could be maximized at wide open throttle.

These and other objects and advantages will be apparent in the variable camshaft timing system for an internal combustion engine having at least one cylinder, a rotatable member such as a crankshaft, and an intake and exhaust valve for the one cylinder, said valves coupled to an intake camshaft and an exhaust camshaft respectively. A pulley wheel is attached at one end of each of the intake and exhaust camshafts and the crankshaft of the engine. A belt means interconnects each of the pulley wheels for transferring rotational motion from the crankshaft to the intake and exhaust camshafts.

First and second idler arm means is attached to the engine for pivotable movement. Attached to each of the idler arm means is an idler wheel positioned in operative contact with the belt means. Cam means are positioned in operative contact with each of the idler arm means to pivotally move the idler arm means. Control signals are generated according to engine operating characteristics and are applied through an electric motor for rotating the cam means to pivotally move the idler arm means changing the relative rotational position between the input camshaft and the exhaust camshaft.

Many other objects and purposes of the invention will be clear from the following detailed description of the drawings.

Detailed Description

Figure 1:
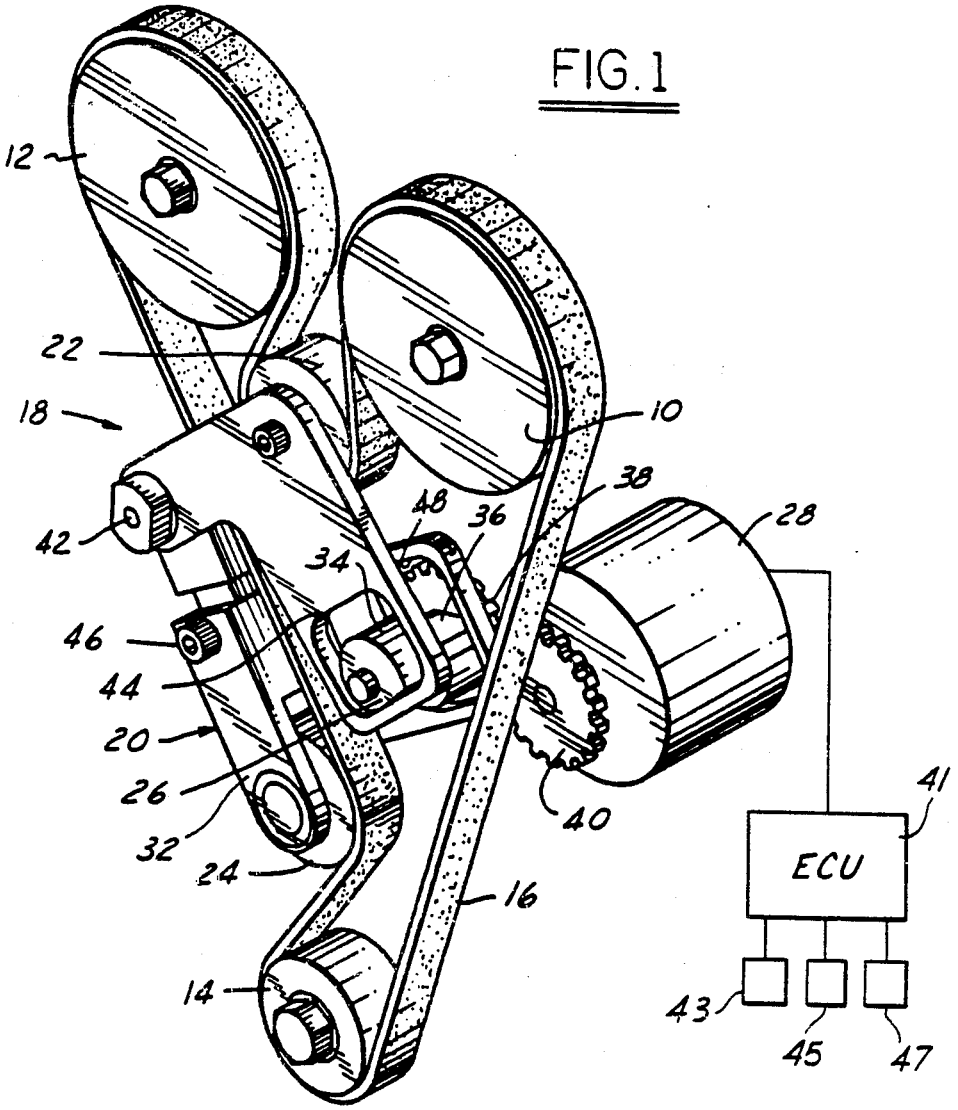
FIG. 1 is a perspective view of the variable camshaft timing mechanism.

There will be described herein an apparatus and a method for varying the camshaft timing for an internal combustion engine having at least one cylinder, a rotatable member such as a crankshaft, and an intake and exhaust valve for the one cylinder. The valves are coupled to an intake camshaft and an exhaust camshaft respectively. A pulley wheel 10,12,14 is attached at one end of each of the intake and exhaust camshafts and the crankshaft of the engine with a belt means 16 interconnecting each of the pulley wheels for transferring rotational motion from the crankshaft to the intake and exhaust camshafts.

A first 18 and second 20 idler arm means are fastened to the engine for pivotable movement. Attached to each of the idler arm means is an idler wheel 22,24 positioned in operative contact with the belt means 16. Cam means 26 is positioned in operative contact with each of the idler arm means 18,20 to pivotally move the idler arm means. Control signals are generated according to engine operating characteristics and are applied through an electric motor 28 for rotating the cam means 26 to pivotally move the idler arm means 18,20 changing the relative rotational position between the input camshaft and the exhaust camshaft.

FIG. 1 illustrates the apparatus for the timing system which is located between the crankshaft and the two camshafts of a typical overhead camshaft internal combustion engine. The crankshaft or moveable member of the engine has a pulley wheel 14 attached at one end thereof. Each of the camshafts also has pulley wheels attached thereto.

For the purpose of description of FIG. 1, the intake camshaft is located to the left of the exhaust camshaft. Attached to the intake camshaft are a plurality of timing cams, not shown, which operate to control the movement of the intake valve for each engine cylinder. In a similar manner, attached to the exhaust camshaft are a plurality of timing cams, not shown, controlling the movement of the exhaust valve for each engine cylinder. None of the mechanisms which are axially positioned on the camshaft from the pulley wheels are shown.

Interconnecting the three pulley wheels is a belt means 16 which may take the form of conventional timing belt, a chain or any other type of flexible member. The tension level in the belt means is maintained by an idler arm means 18,20 comprising an upper or first idler wheel arm 30, an upper idler wheel 22, a lower or second idler wheel arm 32 and a lower idler wheel 24. The idler arm means 18,20 are controlled by first cam means 34 and second cam means 36 of positioning cams 26 operatively connected through a gear means 38,40 to the output of an electric motor 28.

The motor is controlled from an Electronic Control Unit (ECU) 41 which responds to various engine operating sensors 43,45,47 for supplying information in the form of signals relative to the operation of the engine. Stored in a look-up table in the memory contained in the ECU are control signals for positioning the motor 28 in accordance with the desired relative valve timing cam positions at the particular engine operating condition.

In the preferred embodiment, the upper idler wheel arm 30 is an "L" shaped lever pivoted 42 at one end of a leg of the "L", the pivoting leg, and at the end of the other leg or the "L", the cam follower leg, is a cam follower means 44. Positioned intermediate the ends of the lever, at the junction of the pivoting leg and cam follower leg is the upper idler wheel 22. The lower idler wheel 32 arm is a similar shaped lever with the lower idler wheel 24 positioned intermediate the ends of the lever. Both idler wheels 22,24 are rotatably mounted. For purposes of adjusting for belt stretching one of the legs, normally the pivoting leg of the lower idler arm 32 may have an adjustment means 46 for adjusting the length of the leg.

Figure 2:
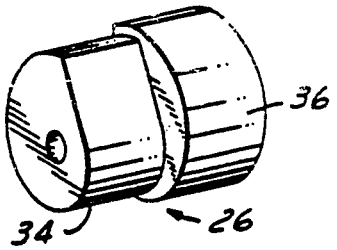
FIG. 2 is a perspective view of the positioning cams of FIG. 1.

The positioning cams 26 in the preferred embodiment are illustrated in FIG. 2. The lower cam 36, which is the cam nearest the gear wheel 38, positions the lower idler wheel 24 and the upper cam 34 which is fixedly attached to the lower cam 36, positions the upper idler wheel 22. The gear wheel 38 can be either a sector gear wheel wherein the gear teeth are on only a portion of the perimeter of the wheel or a full gear. In a similar manner, the mating gear 40 which is driven by the motor means 28, may be either a sector gear or a full gear wheel. The criteria for determining the shape of the gear wheels is a function of the control motor 28 and the gear ratio between the two gears.

The operation of variable camshaft timing system is under the control of the ECU 41. The belt means 16 is positioned around the intake camshaft pulley 12, the upper idler wheel 22 and the exhaust camshaft pulley 10. The belt means 16 from the exhaust camshaft pulley 10 extends directly to the crankshaft pulley wheel 14. The belt 16 wraps around the crankshaft pulley wheel 14 and around the lower idler wheel 24 to the intake camshaft pulley wheel 12. By adjusting the position of the idler wheels 22,24, this endless loop will angularly position the intake camshaft relative to the exhaust camshaft and thereby change the timing of the intake valves to each cylinder of the engine.

Both the upper 22 and lower 24 idler wheels are pivotable from a common pivot point which is typically attached to the engine. As the positioning cams 26 are rotated, both of the idler arm means 18,20 are pivoted in either a clockwise or counterclockwise direction. The angular movement of each idler arm means 18,20 is controlled by the camming surface of its respective positioning cam 34,36. The cooperation between the movement of the upper idler arm 30 and the relative position of the intake camshaft with the exhaust camshaft is controlled by the upper cam 34. The relationship between the movement of the lower idler arm 32 and the tension in the belt means 16 is controlled by the lower cam 36.

The cam follower 44 for the upper idler arm 30 is positioned at the end of the cam follower leg and in the preferred embodiment is the inside surface of predetermined shaped aperture. In a similar manner, the cam follower 48 for the lower idler arm 32 is positioned at the end of the cam follower leg and is also an inside surface of a predetermined shaped aperture.

The various engine operating sensors, 43,45,47, such as engine speed 43, manifold pressure 45, etc., generate signals for the ECU. The ECU addresses a look-up table in its memory and generates control signals to the motor means to position the positioning cams. The motor means 28 functions as a stepping motor in that it drives the gear 40 connected to its armature a predetermined number of angular steps in response to the control signal. The gear 38 on the positioning cams 26 is rotated to position the positioning cams 26. As the positioning cams 26 are being rotated, the cam followers 44,48 are pivoting the idler arms 18,20. Because the function of the two idler wheels 22,24 is different, their respective cam followers 44,48 and positioning cams 26 cause each arm to pivot through a different angular amount.

As the idler arms 30,32 are pivoted, the wrap of the belt means 16 around the intake camshaft pulley 12 rotates the intake camshaft relative to the exhaust camshaft. Thus the cams controlling the intake valves change the opening and closing time of the intake valve as well as the timing of the maximum opening of the valve.

The variable camshaft timing system has been described in connection with the intake camshaft. It is to be understood that the timing system could be equally applied to the exhaust camshaft to rotate the exhaust camshaft relative to the intake camshaft. If this were done, the lower idler wheel 24 would be positioned to bear against the belt means 16 between the crankshaft pulley 14 and the exhaust camshaft pulley 10. However, it has been found that changing the relative timing of the intake camshaft has a greater percentage effect on engine performance than changing the relative timing of the exhaust camshaft. Further, the system could be modified to adjust both camshafts relative to each other and the crankshaft, but the percentage effect on engine performance, while greater than either of singular camshaft adjustments, is not significantly greater to justify the expense.

Many changes and modifications in the above described embodiment of the invention can, of course, be carried out without departing from the scope thereof. Accordingly, that scope is intended to be limited only by the scope of the appended claims.

I claim:

1. A variable camshaft timing system in combination with an internal combustion engine having a rotatable member such as a crankshaft, an intake camshaft and an exhaust camshaft, the system comprising:

at least one pulley wheel means fixedly attached to each of the intake camshaft, the exhaust camshaft and the crankshaft;

at least one belt means for interconnecting various ones of said pulley wheel means;

first and second idler arm means independently pivotally attached to the engine, each of said idler arm means having a pivoting arm, a cam follower means and an idler wheel in operative contact with said at least one belt means; and positioning means operatively coupled to said cam follower means for pivoting said first and second idler arm means and in turn relatively rotating one of said pulley wheel means attached to the intake camshaft with respect to another of said pulley wheel means attached to the exhaust camshaft and for maintaining a predetermined tension in said at least one belt means as said first and second idler arm means are being pivoted.

2. A variable camshaft timing system for an internal combustion engine according to claim 1 wherein said at least one belt means is a chain.

3. A variable camshaft timing system for an internal combustion engine according to claim 1 wherein said idler wheel on said first idler arm means is positioned in operative contact with said at least one belt means between said pulley wheel means attached to the intake camshaft and said pulley wheel means attached to the exhaust camshaft and said idler wheel on said second idler arm means is positioned in operative contact with said at least one belt means between said pulley wheel means attached to the intake camshaft and said pulley wheel means attached to the crankshaft.

4. A variable camshaft timing system for an internal combustion engine according to claim 1 wherein said idler wheel on said first idler arm means is positioned in operative contact with said at least one belt means between said pulley wheel means attached to the intake camshaft and said pulley wheel means attached to the exhaust camshaft and said idler wheel on said second idler arm means is positioned in operative contact with said at least one belt means between said pulley wheel means attached to the exhaust camshaft and said pulley wheel means attached to the crankshaft.

5. A variable camshaft timing system for an internal combustion engine according to claim 1 wherein one of said first and second idler arm means has an adjustment means for taking up slack in said at least one belt means.

6. A variable camshaft timing system for an internal combustion engine according to claim 1 wherein said positioning means operatively coupled to each of said cam follower means of said idler arm means comprises a first cam means for pivoting said first idler arm means and a second cam means for pivoting said second idler arm means, each of said idler arm means being operable for different rotational movements in response to said positioning means.

7. A variable camshaft timing system for an internal combustion engine according to claim 6 wherein said first cam means is operative for relatively rotating the intake camshaft with respect to the exhaust camshaft and said second cam means is operative to maintain a predetermined tension in said at least one belt means.

8. A variable camshaft timing system for an internal combustion engine according to claim 6 wherein said first cam means is operative to control the amount of wrap of said belt means around said pulley on said intake camshaft.

9. A variable camshaft timing system for an internal combustion engine according to claim 1 additionally including:

control means responsive to various engine operating parameters for generating motor control signals; and motor means responsive to said motor control signals and operatively coupled to said positioning means for changing the relative rotational position between the input camshaft and the exhaust camshaft.

10. A variable camshaft timing system for an internal combustion engine according to claim 9 wherein said motor means is an electric stepper motor and said motor control signals operate to step the armature of said motor and said positioning means through an angular position for changing the relative rotational position between the input camshaft and the exhaust camshaft.

11. A variable camshaft timing system for an internal combustion engine according to claim 9 wherein said motor means is an electric motor.

12. A variable camshaft timing system for an internal combustion engine according to claim 9 wherein said control means includes an electronic control unit having a plurality of sensor means each responsive to one of a plurality of engine operating parameters.

13. A variable camshaft timing system for an internal combustion engine according to claim 12 wherein said electronic control unit additionally includes a look-up means responsive to said engine operating parameters for generating said motor control signals.

* * * * *

UNITED STATES PATENT AND TRADEMARK OFFICE

CERTIFICATE OF CORRECTION

PATENT NO. : 4,872,426

DATED : October 10, 1989

INVENTOR(S) : Samuel J. Sapienza, IV

It is certified that error appears in the above-identified patent and that said Letters Patent is hereby corrected as shown below:

On the title page, insert the following:

[*] Notice: The portion of the term of this patent subsequent to May 17, 2005 has been disclaimed.

Signed and Sealed this

Fifteenth Day of October, 1991

*Attest:*

*Attesting Officer*

HARRY F. MANBECK, JR.

*Commissioner of Patents and Trademarks*